US008690664B2

(12) United States Patent
Esses et al.

(10) Patent No.: US 8,690,664 B2
(45) Date of Patent: Apr. 8, 2014

(54) SLOT MACHINE GAME WITH ADDITIONAL AWARD INDICATOR

(75) Inventors: Barbara Esses, Buenos Aires (AR); Matias Montero, Buenos Aires (AR); Jorge Heymann, Buenos Aires (AR)

(73) Assignee: Etasse Limited, Alderney (GB)

( * ) Notice: Subject to any disclaimer, the term of this patent is extended or adjusted under 35 U.S.C. 154(b) by 937 days.

(21) Appl. No.: 11/764,689

(22) Filed: Jun. 18, 2007

(65) Prior Publication Data

US 2008/0076513 A1 Mar. 27, 2008

Related U.S. Application Data

(60) Provisional application No. 60/869,316, filed on Dec. 8, 2006.

(51) Int. Cl.
*G07F 17/34* (2006.01)

(52) U.S. Cl.
USPC ..... 463/25; 463/16; 463/20

(58) Field of Classification Search
USPC ..... 463/16–20, 22, 25
See application file for complete search history.

(56) References Cited

U.S. PATENT DOCUMENTS

| | | | |
|---|---|---|---|
| 4,836,546 | A | 6/1989 | DiRe et al. |
| 5,033,744 | A | 7/1991 | Bridgeman et al. |
| 5,342,049 | A | 8/1994 | Wichinsky et al. |
| 5,401,023 | A | 3/1995 | Wood |
| 5,401,024 | A | 3/1995 | Simunek |
| 5,411,271 | A | 5/1995 | Mirando |
| 5,456,465 | A | 10/1995 | Durham |
| 5,511,781 | A | 4/1996 | Wood et al. |
| 5,676,371 | A | 10/1997 | Kelly et al. |
| 5,704,835 | A | 1/1998 | Dietz, II |
| 5,720,662 | A | 2/1998 | Holmes et al. |
| 5,769,716 | A | 6/1998 | Saffari et al. |
| 5,823,874 | A | 10/1998 | Adams |
| 5,833,537 | A | 11/1998 | Barrie |
| 5,947,821 | A | 9/1999 | Stone |
| 5,976,016 | A | 11/1999 | Moody et al. |
| 6,001,016 | A | 12/1999 | Walker et al. |
| 6,015,346 | A | 1/2000 | Bennett |

(Continued)

FOREIGN PATENT DOCUMENTS

| | | |
|---|---|---|
| EP | 1063622 | 12/2000 |
| EP | 1652562 | 5/2006 |

(Continued)

OTHER PUBLICATIONS

European Patent Office, Supplementary European Search Report for European Application No. EP 06 71 8145, report completed Apr. 30, 2010.

(Continued)

*Primary Examiner* — Arthur O Hall
*Assistant Examiner* — Jasson Yoo
(74) *Attorney, Agent, or Firm* — McDonnell Boehnen Hulbert & Berghoff LLP

(57) ABSTRACT

A method and apparatus to implement special features on slot machine games. An additional award indicator, such as a bonus wheel, a perimeter prize wheel, an additional reel, etc., can be used to modify an award of a main game. The additional award indicator can be successively activated while a resultant combination of mains reels of the slot game remain fixed.

21 Claims, 6 Drawing Sheets

(56) References Cited

U.S. PATENT DOCUMENTS 6,059,659 A 5/2000 Busch et al.
6,070,874 A 6/2000 Ivers
6,120,298 A 9/2000 Jenkins et al.
6,129,632 A 10/2000 Luciano
6,159,097 A 12/2000 Gura
6,174,235 B1 1/2001 Walker et al.
6,186,894 B1 2/2001 Mayeroff
6,193,606 B1 2/2001 Walker et al.
6,210,275 B1 4/2001 Olsen
6,224,483 B1 5/2001 Mayeroff
6,270,409 B1 8/2001 Shuster
6,287,197 B1 9/2001 Dickinson et al.
6,338,678 B1 1/2002 Seelig et al.
6,346,043 B1 2/2002 Colin et al.
6,347,996 B1 2/2002 Gilmore et al.
6,358,147 B1 3/2002 Jaffe et al.
6,390,473 B1 5/2002 Vancura et al.
6,394,899 B1 5/2002 Walker
6,413,161 B1 7/2002 Baerlocher et al.
6,425,824 B1 7/2002 Baerlocher et al.
6,450,888 B1 9/2002 Takase et al.
6,485,367 B1 11/2002 Joshi
6,547,242 B1 4/2003 Sugiyama et al.
6,554,283 B2 4/2003 Vancura et al.
6,575,831 B1 6/2003 Gonen et al.
6,595,854 B2 7/2003 Hughs-Baird et al.
6,601,850 B1 8/2003 Ross
6,604,740 B1 8/2003 Singer et al.
6,609,971 B2 8/2003 Vancura
6,609,974 B2 8/2003 Mead et al.
6,641,477 B1 11/2003 Dietz
6,663,489 B2 12/2003 Baerlocher
6,666,765 B2 12/2003 Vancura
6,669,559 B1 12/2003 Baerlocher et al.
6,695,696 B1 2/2004 Kaminkow
6,709,332 B2 3/2004 Adams
6,731,313 B1 5/2004 Kaminkow
6,752,396 B2 6/2004 Smith
6,761,632 B2 7/2004 Bansemer et al.
6,769,986 B2 8/2004 Vancura
6,780,103 B2 8/2004 Bansemer et al.
6,780,107 B2 8/2004 Baerlocher et al.
6,811,486 B1 11/2004 Luciano, Jr.
6,830,514 B2 12/2004 Meyer et al.
6,855,054 B2 2/2005 White et al.
6,860,810 B2 3/2005 Cannon et al.
6,863,606 B1 3/2005 Berg et al.
6,869,360 B2 * 3/2005 Marks et al. ..... 463/25
6,884,165 B2 4/2005 Baerlocher
6,890,257 B2 5/2005 Baerlocher
6,896,260 B2 5/2005 Pierce
6,902,481 B2 6/2005 Breckner et al.
6,938,068 B1 8/2005 Kraft et al.
6,939,223 B1 9/2005 Jones
6,942,568 B2 9/2005 Baerlocher
6,942,571 B1 9/2005 McAllister et al.
6,950,993 B2 9/2005 Breinberg
6,964,416 B2 11/2005 McClintic et al.
6,966,836 B1 11/2005 Rush et al.
6,984,174 B2 1/2006 Cannon et al.
6,991,539 B2 1/2006 Pacey
6,997,805 B2 2/2006 Vancura
7,036,083 B1 4/2006 Zenith
7,056,210 B2 6/2006 Bansemer et al.
7,066,811 B1 6/2006 DeFrees-Parrott et al.
7,147,559 B2 12/2006 Englman
7,175,524 B2 2/2007 Bansemer et al.
7,175,527 B2 2/2007 Bryant
7,192,346 B2 3/2007 Mathis
7,252,589 B1 8/2007 Marks et al.
7,264,545 B2 9/2007 Maya et al.
7,275,989 B2 10/2007 Moody
7,326,115 B2 2/2008 Baerlocher
7,341,513 B2 3/2008 Cuddy et al.
7,364,506 B2 4/2008 Jaffe et al.
7,367,883 B2 5/2008 Gagnon
7,371,173 B2 5/2008 Gatto et al.
7,377,850 B2 5/2008 Shackelford et al.
7,393,278 B2 7/2008 Gerson et al.
7,470,193 B2 12/2008 Umezaki
7,534,168 B2 5/2009 Bennett et al.
7,559,836 B2 7/2009 Gerson et al.
7,585,219 B2 9/2009 Randall et al.
7,631,872 B2 12/2009 Roemer et al.
7,690,996 B2 4/2010 Iddings et al.
7,713,123 B2 5/2010 Gerson et al.
7,727,063 B2 6/2010 Walker et al.
7,753,790 B2 7/2010 Nguyen et al.
7,771,279 B2 8/2010 Miyamoto et al.
7,789,749 B2 9/2010 Bansemer et al.
7,819,748 B2 10/2010 Ajioka
7,846,015 B2 12/2010 Bansemer et al.
8,231,453 B2 7/2012 Wolf et al.
8,475,262 B2 7/2013 Wolf et al.
2001/0003709 A1 6/2001 Adams
2001/0009865 A1 7/2001 Demar et al.
2001/0031659 A1 10/2001 Perrie et al.
2002/0010017 A1 1/2002 Bennett
2002/0027323 A1 3/2002 Vancura et al.
2002/0043759 A1 4/2002 Vancura
2002/0045474 A1 * 4/2002 Singer et al. ..... 463/20
2002/0049082 A1 4/2002 Bansemer et al.
2002/0052234 A1 5/2002 Adams
2002/0058545 A1 5/2002 Luciano
2002/0077165 A1 6/2002 Bansemer et al.
2003/0003980 A1 1/2003 Moody
2003/0013514 A1 1/2003 Cregan et al.
2003/0022711 A1 1/2003 Locke et al.
2003/0027619 A1 2/2003 Nicastro
2003/0027639 A1 2/2003 Peterson et al.
2003/0036423 A1 2/2003 Vancura
2003/0040355 A1 * 2/2003 Baerlocher ..... 463/20
2003/0060276 A1 3/2003 Walker et al.
2003/0060278 A1 3/2003 Walker et al.
2003/0060281 A1 3/2003 Vancura
2003/0064782 A1 4/2003 Beaulieu et al.
2003/0064797 A1 4/2003 Jackson et al.
2003/0064800 A1 4/2003 Jackson et al.
2003/0092476 A1 5/2003 Fox
2003/0092480 A1 5/2003 White et al.
2003/0100361 A1 5/2003 Sharpless et al.
2003/0119576 A1 6/2003 McClintic et al.
2003/0119581 A1 6/2003 Cannon et al.
2003/0125107 A1 7/2003 Cannon
2003/0130027 A1 7/2003 Aida
2003/0153375 A1 8/2003 Vancura
2003/0162584 A1 8/2003 Hughs-Baird et al.
2003/0162585 A1 * 8/2003 Bigelow et al. ..... 463/20
2003/0181231 A1 9/2003 Vancura et al.
2003/0186733 A1 10/2003 Wolf et al.
2003/0195027 A1 10/2003 Baerlocher et al.
2003/0195034 A1 10/2003 Dunaevsky
2003/0224849 A1 12/2003 Geiger
2004/0014517 A1 1/2004 Inoue
2004/0023715 A1 2/2004 Luciano, Jr.
2004/0036216 A1 2/2004 Vancura
2004/0048650 A1 3/2004 Mierau et al.
2004/0053657 A1 3/2004 Fiden et al.
2004/0053683 A1 3/2004 Hartl et al.
2004/0063483 A1 4/2004 Wolf et al.
2004/0072603 A1 4/2004 Shuster
2004/0092300 A1 5/2004 Gauselmann
2004/0116173 A1 6/2004 Baerlocher
2004/0121838 A1 6/2004 Hughs-Baird et al.
2004/0127280 A1 7/2004 Moody
2004/0152509 A1 8/2004 Hornik et al.
2004/0176157 A1 9/2004 Walker et al.
2004/0198490 A1 10/2004 Bansemer et al.
2004/0204233 A1 10/2004 Saffari et al.
2004/0209662 A1 10/2004 Wadleigh
2004/0219969 A1 11/2004 Casey et al.
2004/0235548 A1 11/2004 Benbrahim
2004/0235556 A1 * 11/2004 Flemming et al. ..... 463/20
2004/0242316 A1 12/2004 Oles et al.

(56) References Cited

U.S. PATENT DOCUMENTS

| | | | | |
|---|---|---|---|---|
| 2005/0014551 | A1 | 1/2005 | Packes et al. | |
| 2005/0014557 | A1 | 1/2005 | Duhamel | |
| 2005/0014563 | A1 | 1/2005 | Barri | |
| 2005/0026664 | A1 | 2/2005 | Bansemer et al. | |
| 2005/0026679 | A1 | 2/2005 | Lucchesi et al. | |
| 2005/0032566 | A1 | 2/2005 | Baerlocher et al. | |
| 2005/0033711 | A1 | 2/2005 | Horvitz et al. | |
| 2005/0054416 | A1* | 3/2005 | Hostetler et al. | 463/16 |
| 2005/0054430 | A1 | 3/2005 | Pitman et al. | |
| 2005/0085285 | A1 | 4/2005 | Muskin | |
| 2005/0090307 | A1 | 4/2005 | Walker et al. | |
| 2005/0107154 | A1 | 5/2005 | Pacey | |
| 2005/0119040 | A1 | 6/2005 | Berman et al. | |
| 2005/0130737 | A1 | 6/2005 | Englman et al. | |
| 2005/0137007 | A1 | 6/2005 | Schaufelberger | |
| 2005/0153765 | A1 | 7/2005 | Shoostine | |
| 2005/0153770 | A1 | 7/2005 | Vancura | |
| 2005/0164794 | A1 | 7/2005 | Tahara | |
| 2005/0176494 | A1 | 8/2005 | Thomas | |
| 2005/0181866 | A1 | 8/2005 | Baerlocher | |
| 2005/0187005 | A1 | 8/2005 | Rose | |
| 2005/0187023 | A1 | 8/2005 | Miyamoto et al. | |
| 2005/0202864 | A1 | 9/2005 | Duhamel et al. | |
| 2005/0202869 | A1 | 9/2005 | Miyamoto et al. | |
| 2005/0215311 | A1 | 9/2005 | Hornik et al. | |
| 2005/0266916 | A1 | 12/2005 | Sato et al. | |
| 2005/0277469 | A1 | 12/2005 | Pryzby et al. | |
| 2006/0003831 | A1 | 1/2006 | Falciglia | |
| 2006/0019738 | A1 | 1/2006 | Baerlocher et al. | |
| 2006/0030398 | A1 | 2/2006 | Hornik | |
| 2006/0046818 | A1 | 3/2006 | Goins | |
| 2006/0046853 | A1 | 3/2006 | Black | |
| 2006/0063584 | A1* | 3/2006 | Brill et al. | 463/20 |
| 2006/0073863 | A1 | 4/2006 | Hagiwara | |
| 2006/0073878 | A1* | 4/2006 | Shackelford et al. | 463/20 |
| 2006/0121972 | A1 | 6/2006 | Walker et al. | |
| 2006/0121978 | A1 | 6/2006 | Hornik et al. | |
| 2006/0160595 | A1 | 7/2006 | Gerson et al. | |
| 2006/0160614 | A1 | 7/2006 | Walker et al. | |
| 2006/0172791 | A1 | 8/2006 | Wolf | |
| 2006/0181028 | A1 | 8/2006 | Benator | |
| 2006/0183536 | A1 | 8/2006 | Gagner et al. | |
| 2006/0189377 | A1 | 8/2006 | Gomez et al. | |
| 2006/0189378 | A1 | 8/2006 | Aoki | |
| 2006/0205483 | A1 | 9/2006 | Meyer et al. | |
| 2006/0240890 | A1 | 10/2006 | Walker et al. | |
| 2006/0247035 | A1 | 11/2006 | Rowe et al. | |
| 2006/0252494 | A1 | 11/2006 | Gerson et al. | |
| 2006/0252495 | A1 | 11/2006 | Gerson et al. | |
| 2006/0264255 | A1 | 11/2006 | Borissov | |
| 2007/0060254 | A1 | 3/2007 | Muir | |
| 2007/0060314 | A1 | 3/2007 | Baerlocher et al. | |
| 2007/0077988 | A1 | 4/2007 | Friedman | |
| 2007/0087805 | A1* | 4/2007 | Taylor | 463/16 |
| 2007/0102877 | A1 | 5/2007 | Personius et al. | |
| 2007/0161424 | A1 | 7/2007 | Gatto et al. | |
| 2007/0167217 | A1 | 7/2007 | Kaminkow et al. | |
| 2007/0171192 | A1 | 7/2007 | Seo et al. | |
| 2007/0190495 | A1 | 8/2007 | Kendir et al. | |
| 2007/0281774 | A1 | 12/2007 | Khal | |
| 2007/0287523 | A1 | 12/2007 | Esses et al. | |
| 2008/0045295 | A1 | 2/2008 | Walker et al. | |
| 2008/0076513 | A1 | 3/2008 | Esses et al. | |
| 2008/0076518 | A1 | 3/2008 | Yoshizawa | |
| 2008/0102923 | A1 | 5/2008 | Esses et al. | |
| 2008/0113769 | A1 | 5/2008 | Montero et al. | |
| 2008/0119260 | A1 | 5/2008 | Nores | |
| 2008/0119261 | A1 | 5/2008 | Heymann | |
| 2008/0153570 | A1 | 6/2008 | Esses et al. | |
| 2008/0167116 | A1 | 7/2008 | Gerson | |
| 2008/0214292 | A1 | 9/2008 | Bryant et al. | |
| 2008/0234032 | A1 | 9/2008 | Brunet de Courssou et al. | |
| 2008/0274798 | A1 | 11/2008 | Walker et al. | |
| 2008/0310302 | A1 | 12/2008 | Detwiler et al. | |
| 2008/0318660 | A1 | 12/2008 | Nores | |
| 2009/0005145 | A1 | 1/2009 | White | |
| 2009/0029773 | A1 | 1/2009 | Cherry | |
| 2009/0029779 | A1 | 1/2009 | Murase et al. | |
| 2009/0061982 | A1 | 3/2009 | Brito | |
| 2009/0064000 | A1 | 3/2009 | Garbow et al. | |
| 2009/0082080 | A1 | 3/2009 | Bennett et al. | |
| 2009/0093296 | A1 | 4/2009 | Gerson et al. | |
| 2009/0104977 | A1 | 4/2009 | Zielinski | |
| 2009/0124328 | A1 | 5/2009 | Nores | |
| 2009/0124352 | A1 | 5/2009 | Gerson | |
| 2009/0286586 | A1 | 11/2009 | Heymann et al. | |
| 2010/0004048 | A1 | 1/2010 | Brito | |
| 2010/0029376 | A1 | 2/2010 | Hardy et al. | |
| 2010/0029378 | A1 | 2/2010 | Gerson et al. | |
| 2010/0048284 | A1 | 2/2010 | Jaffe | |
| 2010/0210356 | A1 | 8/2010 | Losica | |
| 2010/0240456 | A1 | 9/2010 | Goto et al. | |
| 2010/0331071 | A1 | 12/2010 | Uchiyama et al. | |
| 2011/0281627 | A1 | 11/2011 | Lutnick et al. | |
| 2012/0052939 | A1 | 3/2012 | Lutnick et al. | |

FOREIGN PATENT DOCUMENTS

| | | | |
|---|---|---|---|
| GB | 2148037 | | 5/1985 |
| GB | 2335524 | | 9/1999 |
| WO | 2006076424 | A3 | 7/2006 |
| WO | 2006076462 | A3 | 7/2006 |
| WO | 2007076514 | A3 | 7/2007 |
| WO | 2007143704 | A3 | 12/2007 |
| WO | 2008039413 | A3 | 4/2008 |
| WO | 2008051518 | A3 | 5/2008 |
| WO | 2008057188 | | 5/2008 |
| WO | 2008057201 | A3 | 5/2008 |
| WO | 2008060472 | A3 | 5/2008 |
| WO | 2008060473 | A3 | 5/2008 |
| WO | 2009032130 | A3 | 3/2009 |

OTHER PUBLICATIONS

Illinois Lottery Office of the Superintendent Game Rules, Downloaded from the World Wide Web at http://webarchive.org/web/w0061109031843/http://www.illinoislottery.com/subsections/OnLineRules.htm, downloaded on Sep. 28, 2011 as archived on Nov. 9, 2006.

International Searching Authority, Notification of Transmittal of the International Search Report and the Written Opinion of the International Searching Authority, or the Declaration, for International Application No. PCT/US07/23656, mailed on Aug. 25, 2008.

International Searching Authority, Notification of Transmittal of the International Search Report and the Written Opinion of the International Searching Authority, or the Declaration, for International Application No. PCT/US07/74030, mailed on Sep. 26, 2008.

International Searching Authority, Written Opinion of the International Searching Authority (PCT Rule 43 bis.1), for International Application No. PCT/US07/23658, mailed on Sep. 22, 2008.

United States Patent and Trademark Office, Office Action for U.S. Appl. No. 11/873,740, dated Jun. 9, 2008.

"Nintendogs" instruction booklet by Nintendo of America, Inc., http://www.nintendo.com/consumer/gameslist/manuals/DS_Nintendogs.pdf, Jul. 15, 2005.

International Searching Authority of WIPO, PCT Written Opinion of the International Searching Authority, for International Application No. PCT/US07/22425, mailing date Jul. 24, 2008.

International Searching Authority of WIPO, PCT Written Opinion of the International Searching Authority for International Application No. PCT/US08/10156, mailed on Jun. 25, 2009.

The International Bureau of WIPO, PCT International Preliminary Report on Patentability, for International Application PCT/US2006/000346, report issued on Jul. 8, 2008.

The International Bureau of WIPO, PCT International Preliminary Report on Patentability for International Application PCT/US2006/001034, issued on Nov. 19, 2007.

The International Bureau of WIPO, PCT International Preliminary Report on Patentability, for International Application PCT/US2006/062630, report issued on Jul. 1, 2008.

(56) References Cited

OTHER PUBLICATIONS

The International Bureau of WIPO, PCT International Preliminary Report on Patentability, for International Application PCT/US2007/20589, report issued on Mar. 31, 2009.
The International Bureau of WIPO, PCT International Preliminary Report on Patentability, for International Application PCT/US2007/022425, report issued on May 12, 2009.
The International Bureau of WIPO, PCT International Preliminary Report on Patentability, for International Application PCT/US2007/022426, report issued on Apr. 28, 2009.
The International Bureau of WIPO, International Preliminary Report on Patentability, for International Application PCT/US2007/022775, report issued on Apr. 28, 2009.
The International Bureau of WIPO, PCT International Preliminary Report on Patentability, for International Application PCT/US2007/023657, report issued on May 12, 2009.
Government of MACAO Special Administrative Region, International-Type Search Report and Office Action for application No. 1/0004388(880), cover sheet dated Apr. 17, 2009.
Wikipedia, "Wheel of Fortune," http://en.wikipedia.org/wiki/Wheel_of_Fortune, printed Dec. 8, 2008.
International Searching Authority, PCT Written Opinion of the International Searching Authority (PCT Rule 43 bis.1), for International Application No. PCT/US07/23656, mailed on Aug. 25, 2008.
The International Bureau of WIPO, PCT International Preliminary Report on Patentability, for International Application PCT/US2007/023658, report issued on May 12, 2009.
International Searching Authority, Notification of Transmittal of the International Search Report and the Written Opinion of the International Searching Authority, or the Declaration, for International Application No. PCT/US07/22775, dated Aug. 15, 2008.
U.S. Appl. No. 11/558,405, filed Nov. 9, 2006, inventor Matias Montero and entitled System and Method for allowing piggyback wagering.
U.S. Appl. No. 12/773,847, filed May 5, 2010.
Sony Pictures Television—Wheel of Fortune 20th Anniversary—downloaded from http://webarchive.org/web/20030624010929/http://www.wheeloffortune.com/, Jun. 24, 2003.
Instructions for "Clue Classsic Detective Game," Hasbro, Inc. copyright 1986, available at http://www.hasbro.com/common/instruct/clueins.pdf, last accessed on Jun. 24, 2013, 4 pages.

* cited by examiner

TOTAL BET: $15
LINES: 15
BET PER LINE: $1

MAIN WIN: $5
ADDITIONAL WIN: $15
TOTAL WIN: $20

SLOT MACHINE GAME WITH ADDITIONAL AWARD INDICATOR

CROSS REFERENCE TO RELATED APPLICATIONS

This application claims benefit of application 60/869,316 filed Dec. 8, 2006, which is incorporated by reference herein in its entirety.

This Application is also related to the following applications identified by their application Ser. No. 11/035,691 ("Slot Machine Game that Allows Player to Purchase Reel Respins"); Ser. No. 11/326,125 ("Slot Machine Bonus Game); Ser. No. 11/337,960 ("Slot Machine with Skill Aspect"); Ser. No. 11/558,405 ("System and Method for Allowing Piggyback Wagering"); Ser. No. 11/609,315 ("System and Method for Allowing Piggyback Wagering"); Ser. No. 11/459,253 ("Slot Machine Bonus Game"); Ser. No. 11/558,564 ("System and Method for Administering a Progressive Jackpot Limited to a Bonus Round"); Ser. No. 11/11/678,050 ("Slot Machine Game With Additional Features"). All eight of these applications are incorporated by reference herein in their entireties for all purposes. Any and all features of any of these applications can be combined with each other and with any feature(s) described herein.

BACKGROUND OF THE INVENTION

1. Field of the Invention

The present inventive concept relates to a system, method, and computer readable storage, for providing additional features to slot machine games.

2. Description of the Related Art

Slot machine games are a billion dollar industry. The current three or five reel machines have been around for a long time and some players may find current game play monotonous.

What is needed are additional slot machine features which will generate more excitement for players and/or more revenue as well.

SUMMARY OF THE INVENTION

It is an aspect of the present general inventive concept to provide additional features to slot machine games.

The above aspects can also be obtained by a method that includes (a) receiving a main wager from a player; (b) spinning reels on the slot machine; (c) spinning a perimeter prize wheel surrounding the reels; (d) stopping the spinning reels to a final reel combination; (e) stopping the spinning perimeter prize wheel to a resultant prize; (f) determining an award based the main wager and the final reel combination; (g) modifying the award based on the resultant prize to a modified award; and (h) awarding the modified award.

The above aspects can also be obtained by a method that includes (a) receiving an initial wager from a player; (b) spinning main reels on the slot machine to a final reel combination; (c) determining an award based on the final reel combination and the initial wager; (d) activating an additional award indicator which comprises at least one multiplier which multiplies the award if selected; (e) awarding a first additional award based on the activating; (f) activating a second time an additional award indicator which comprises at least one multiplier which multiples the award if selected; and (g) awarding a second additional award based on the activating the second time.

The above aspects can also be obtained by a method that includes (a) receiving an initial wager from a player; (b) spinning main reels on the slot machine to a final reel combination; (c) determining an award based on the final reel combination and the initial wager; (d) activating an additional award indicator which comprises at least one multiplier which multiplies the award if selected; (e) awarding a first additional award based on the activating; (f) spinning a second time the main reels to a second final reel combination; (g) determining a second award based on the second final reel combination and the initial wager; (h) activating a second time an additional award indicator which comprises at least one multiplier which multiples the second award if selected; and (i) awarding a second additional award based on the activating the second time.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
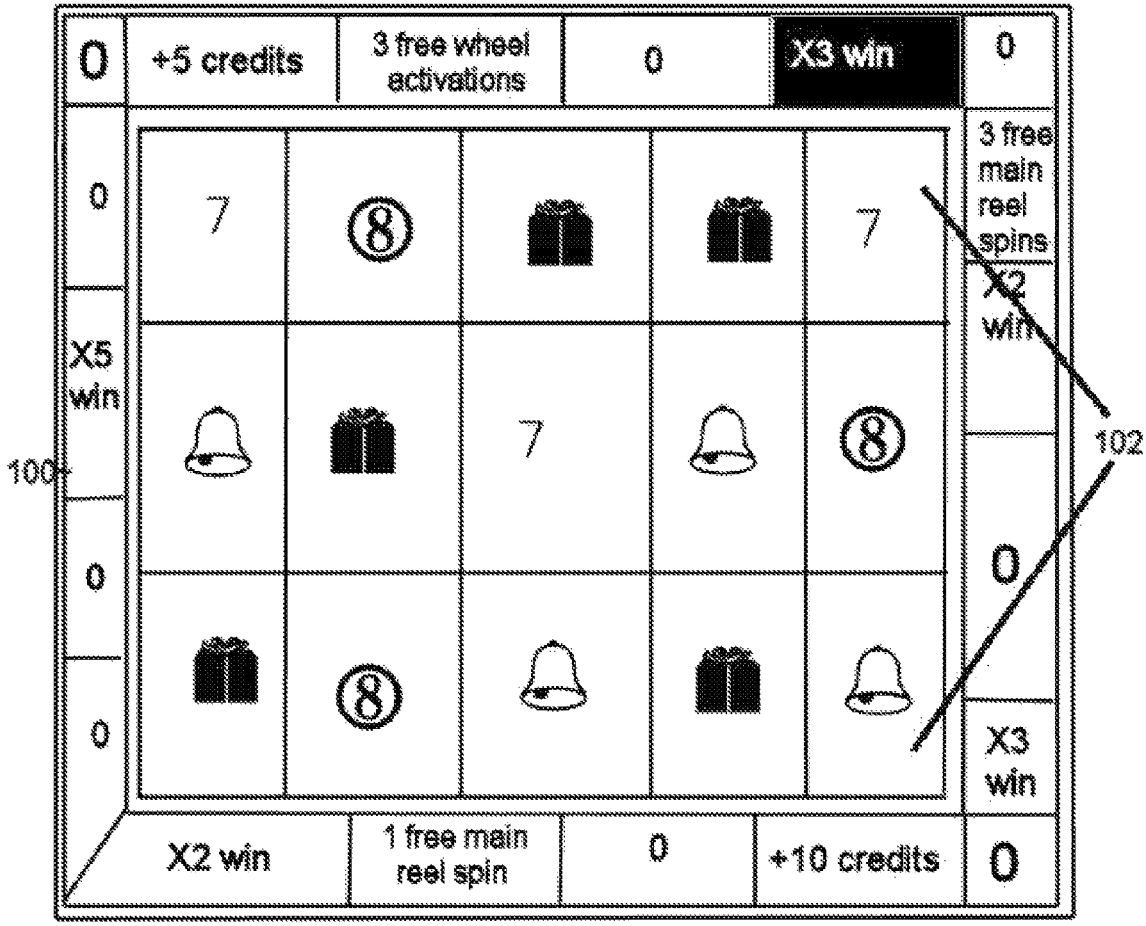
FIG. 1 is an exemplary output of a perimeter prize wheel, according to an embodiment.

Reference will now be made in detail to the presently preferred embodiments of the invention, examples of which are illustrated in the accompanying drawings, wherein like reference numerals refer to like elements throughout.

Embodiments of the invention relate to slot machine games, where typically a player places a wager, presses a button to spin the reels, the reels each stop at a random position, payouts are determined by comparing all paylines played to a predetermined set of winning combinations, and then the determined payouts, if any, are awarded to the player based on the wager. Additional features can augment the excitement of a player and may also result in increased action for the casino.

In a first embodiment, a slot machine can display a perimeter prize wheel 100 (which is a type of additional award indicator). When main reels 102 of a slot machine are spun (any type of slot machine, 3 reel, 5 reel, etc., mechanical, video, etc.), the squares that comprise the perimeter prize wheel can also light up. The main reels 102 are the reels that are used to form combinations which pay on an initial wager (a main slot game).

In FIG. 1, the main reels 102 are a 5 by 3 reel configuration (five symbols horizontally by three symbols vertically). A variety of effects can be used to light up these squares, for example, they can be lit up in adjacent order (e.g. clockwise or counterclockwise), or they can lit up at random. After the reels stop spinning, the perimeter prize wheel stops spinning as wheel and a final square on the perimeter prize wheel lights up. This final square is the prize the player has won (a selected award). This prize can be one of: nothing; any number of free spins of the main reels; any number of free activations of the additional award indicator; a multiplier (such that whatever award {if any} the player has won on the reeled game is multiplied by this amount); any amount of credits; entries into a bonus round (which would otherwise require a particular reel combination to trigger entry into the bonus round); or any other prize/award.

In the example in FIG. 1, the prize/award or "×3 win" (three times multiplier) has been selected on the perimeter prize wheel. Thus the main award of $5 is multiplied by $3 (=$15) which is the award based on an outcome (selection) of the perimeter prize wheel.

The prizes the player may win on the perimeter prize wheel can be paid for in a number of ways. These prizes can simply be factored into the machine's overall return, such that the player does not need to pay extra to activate the prize wheel. Alternatively, the player may be required to pay additional coins (in additional to the amount the player wishes to play on the standard reeled game) in order to activate the prize wheel. For example, if the player is playing a 9 line slot game, and is playing 5 coins per line, for a total of 45 coins a spin. The player may optionally (or be required to) play an additional coin per line, or 54 coins total, in order to activate the perimeter prize wheel.

The squares (prize) that ends up lighting up on the perimeter prize wheel can be truly random, or the prize wheel can be weighted such that certain prizes may be more likely to result than others.

All of the prizes on the wheel can also be fixed for every spin or alternatively they can vary from spin to spin. In the latter embodiment, the prizes on the wheel can be chosen from random and/or can reflect an amount wagered on the main game. For example, if the player is wagering only one coin/line (or under a predetermined threshold), then the highest multiplier on the wheel may only be 2×. If the player is betting more than a predetermined threshold, then the highest multiplier on the wheel might be 5×. Once all of the prizes to be displayed are selected, then the wheel can start "spinning."

In an embodiment, the player can pay separately to play the perimeter prize wheel as well as pay separately to spin the reels on the main game. The player can choose which game to player (either one or both).

As an example of this claim, the player bets $10 ($1/line with 9 lines+$1 to activate the perimeter prize wheel), the reels then spin and so does the perimeter prize wheel. The reels then stop at a final reel combination and the player has won $5 based on the final reel combination; the perimeter prize wheel stops at 2× multiplier. Thus, the player has now won $10, for a net win of $0.

Also, note that a prize on the perimeter prize wheel can also award entry into a bonus round as an award. Typically, to enter a bonus round the player needs to receive a predetermined combination of symbols on the reels. If the player does not receive the predetermined combination of symbols, but nevertheless wins an entry to the bonus round on the perimeter prize wheel, the player then enters the bonus round. A bonus round is known in the art as a special game, different than the main game of spinning reels, where the player can win additional prizes.

In a further variation, instead of using a perimeter wheel as illustrated in FIG. 1, prizes/awards can appear on a separate reel (e.g., in a 3 reel slot game, a fourth reel can spin which displays and awards the prizes). Alternatively, the separate reel can appear in a separate window on the game. Alternative, the additional prizes/awards can appear on a wheel. Thus any embodiment described herein can also be applied to this embodiment (a separate reel or window to award the prizes instead of using the perimeter prize wheel). Thus, anywhere "perimeter prize wheel" appears herein, this can also be substituted for an additional reel or window. Any way an additional award can be displayed to a player (such as all of those mentioned herein such as a perimeter prize wheel and others) can be referred to herein as an additional indicator or an additional award indicator. It is also noted that some selected prizes/awards earned from an activation of an additional award indicator may award nothing ($0), e.g., if a particular area or symbol is the one that is selected on the additional award indicator that awards nothing, then the prize is zero.

Note that an award (or prize) on the wheel is "3 free wheel activations," thus if award is selected, then the player would get three free activations (spins) of the perimeter prize wheel and any resultant award(s) for each of the three spins. Contrast this to the award of "3 free main reel spins" which would spin the main reels three times and generate three awards based on the resultant combination for each spin.

Figure 2:
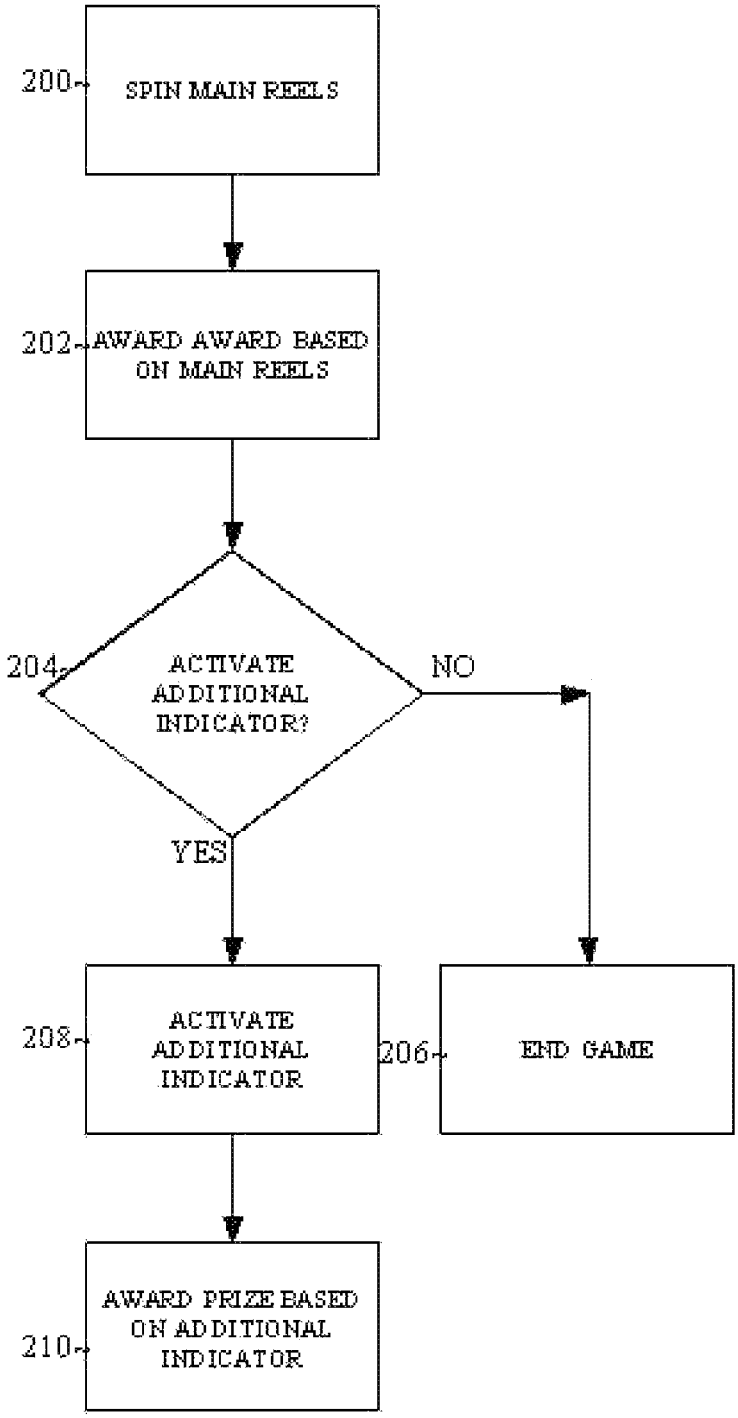
FIG. 2 is a flowchart illustrating an exemplary method of implementing an additional award indicator, according to an embodiment.

FIG. 2 is a flowchart illustrating an exemplary method of implementing an additional award indicator, according to an embodiment.

The method can start with operation 200, wherein spins the main reels of a slot machine game. Before the reels are spun, an initial wager is received from the player, and the player pushes a "spin" button to spin the reels. The player can also determine how much the initial wager is. This can be based on a number of factors, such as how many lines (or paylines) the player wishes to bet on and how much to bet on each line. The player is typically free to which how many and which paylines he wishes to bet on and how much to bet per payline. A payline is a set of predetermined symbol positions on the main reels which combine to form combinations, the combinations of which are checked against a paytable to determine whether they are winning combinations and how much is the respective win. A five reel game (with three symbols displayed vertically on each reel) can have up to 243 (3^5) paylines, but of course it can have less, such as nine or 15. Thus, if a player decides to play 15 paylines at $1 each, then the player's initial wager can be $15. The player can indicate how much he or she wishes to bet, and how many/which payline(s) to bet on using buttons and/or a touch screen interface.

From operation 200, the method can proceed to operation 202, which awards an award based on the main reels. This is done as known in the art. For example, all of the active paylines (paylines paid for in operation 200) that contain winning combinations are paid awards based on a paytable.

Form operation 202, the method can proceed to operation 204, which determines whether to activate an additional indicator. The additional indicator can be a perimeter prize wheel, a bonus wheel, an additional reel, etc., or any other structure that can display and choose an additional award. The activation of the additional indicator will animate the additional indicator until it stops and displays a particular award (or no award). For example, lights on the perimeter prize wheel will light up clockwise (or counterclockwise or randomly) until a final award is selected (stays lit up). A bonus wheel will spin until a final award is displayed (pointed to, highlighted, etc.) An additional reel can spin until the reel stops to display a final award.

The determination of whether to activate the additional indicator can be made in a number of ways. For example, the determination can be purely random, for example, there can be a 10% (or any probability) chance that the additional indicator will activate. Alternatively, the additional indicator can be activated based on a combination on the main reels (e.g., if a particular combination(s) appears, then the additional indicator can activate). Alternatively, the additional indicator can activate every time the main reels are spin (in this embodiment operation 204 is unnecessary since the additional indicator will always activate).

If the determination in operation 204 determines that the additional indicator will not activate, then the method can proceed to operation 206, wherein the game ends. A new game can then begin, returning to operation 200.

If the determination in operation 204 determines that the additional indicator will activate, then the method can proceed to operation 208, which activates the additional indicator. The additional indicator can light up and/or animate to indicate that it is being activated (e.g., spin, flash, light up prizes, etc.) The additional indicator (or additional award indicator) will then output a selected (or obtained) award that the player will win from the additional indicator (can also be a lack of an award {e.g., $0 win}). The prize/award selected/obtained would typically be determined randomly.

From operation 208, the method can proceed to operation 210, which awards the prize displayed on the additional indicator as the selected prize (e.g., where the wheel or reel stops). The prize can be selected from a number of different awards, for example a multiplier which multiplies an award on the main reels (e.g., 3 times all wins awarded in operation 202), a monetary award (e.g., awards $20), free spins of the main reels (e.g., 4 free spins of the main reels are awarded), free spins of the additional indicator (e.g., 3 spins of the additional indicator), a direct entry into a bonus round, no award (e.g., the selected symbol on the additional indicators says zero or is blank, etc.

The awards that can be potentially awarded on the additional indicator can be funded in a number of different ways. In an embodiment, no additional money needs to be paid by the player to activate the additional indicator. In another embodiment, the player needs to make an additional wager in order that the additional indicator may potentially activate. For example, the player can pay an additional $1 on top of a main wager placed in operation 200 in order for the additional indicator to activate or potentially activate (depending on the embodiment described herein). For example, the additional indicator can activate each time the main reels are spin and the player pays the $1 (or any amount to activate the additional indicator). Alternatively, the player can pay an additional wager (e.g., $1) for the possibility of activating the additional indicator (e.g., the additional indicator may activate with only a 10% probability or based on whether a resultant combination of the main reels displays a particular combination).

Thus, if the embodiment being implemented requires the player to make a separate wager (or payment) in order to activate the additional award indicator, then if the player has not made such wager then the additional award indicator will not activate. If the player has made such wager, then the additional award indicator may always activate (in one embodiment) or in another embodiment will be activated only if an activation condition occurs (as described herein).

It is noted that the operations in FIG. 2 (and any other figure herein) can be performed in any order. For example, operation 202 (which awards a prize based on the main reels) can be performed any other point in time after the reels have been spin (e.g., along with operation 210 or in operation 214). Prizes can be determined and/or awarded at any point in time. Typically, the award determined in operation 202 is to be awarded to the player only once, although awards using the additional indicator (such as a multiplier) can incorporate the award from operation 202 (e.g., awarding a multiplier of two times the award).

In an embodiment, the main reels can spin and stop, a prize can be awarded (or determined and awarded later), and the additional indicator can be activated more than one time.

Figure 3:
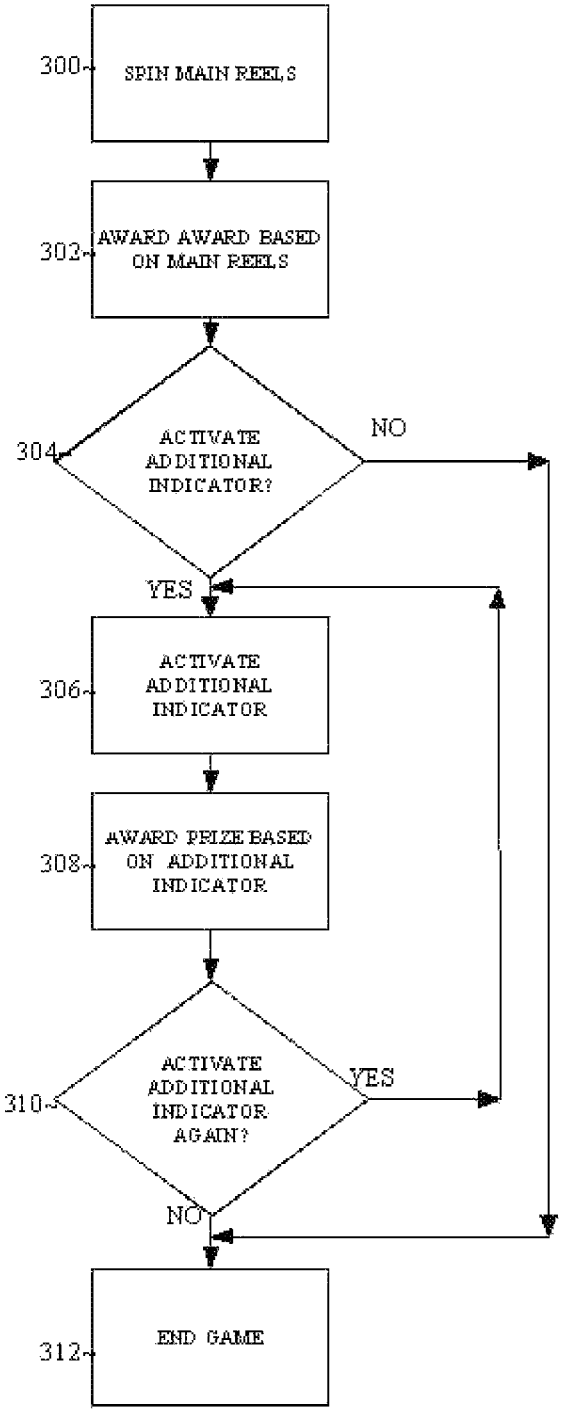
FIG. 3 is a flowchart illustrating an exemplary method of implementing an additional award indicator with multiple activations, according to an embodiment.

FIG. 3 is a flowchart illustrating an exemplary method of implementing an additional award indicator with multiple activations, according to an embodiment.

The method can start with operation 300, which spins the main reels. A wager can be received, and the reels are then be spun.

From operation 300, the method can proceed to operation 302, which awards an award based on combinations formed on active paylines (paylines that the player has wagered on in operation 300) on the main reels. Typically, the award determined based on the reel combinations displayed in operation 300 is awarded to the player only once, although additional awards using the additional indicator may be awarded which may incorporate the award determined in operation 302 (e.g., a multiplier).

From operation 302, the method can proceed to operation 304, which determines whether to activate an additional indicator. The determination can be made as described herein. For example, either a purely random determination can be made, or a determination can be made whether a particular combination(s) occurs on the main reels. Alternatively, the additional indicator can be activated every N number of plays of the main game (spins of the main reels), e.g., the additional indicator would not spin unless it was the fifth (or any number) play of the main game. For example, a particular combination on the main reels can trigger an award of 4 (or any number) of activations of the additional award indicator. Further, the additional indicator can be activated if the player paid to activate the additional indicator (at any point in time, such as during operation 300).

If the determination in operation 304 determines that the additional indicator is not to be activated, then the method can proceed to operation 312, which ends the game. A new game can then begin if the player so desires.

If the determination in operation 304 determines that the additional indicator should be activated, then the method can proceed to operation 306 which activates the additional indicator. The additional indicator can then animate and stop, displaying a selected award.

From operation 306 the method can proceed to operation 308 which awards a prize based on the selected award.

From operation 308, the method can proceed to operation 310, which determines whether to activate the additional indicator again. This is based on a number of activation(s) the player is entitled to, which can be determined in a number of ways. For example, after the reels stop spinning in operation 300, a combination(s) on the reels can determine a number of additional indicator activations. For example, a combination resulting from the main game may award five activations of the additional indicator (e.g., five spins of a bonus wheel, each spin awarding a prize). Alternatively, the player may receive more than one activation of the additional indicator automatically (e.g., every fifth spin of the main game the player gets two additional indicator activations). Alternatively, the player can purchase as many additional indicator activations as the player wishes. For example, the player can place an initial (or main) wager for the main game. The player can also optionally bet additional money in order to activate the additional indicator. The player may also be allowed to purchase multiple activations of the additional indicator. For example, the player may place a $2 initial wager. Each activation of the additional indicator may cost $1, thus the player may wish to bet an additional $3 for three successive activations of the additional indicator. Thus, the player has be a total of $5, $2 for the main game which awards a prize based on the main reels (without consideration of the additional indicator), and three activations of the additional indicator (typically while the main reels remain the same).

If the determination in operation 310 determines not to activate the additional indicator again, then the method can proceed to operation 312 which ends the game.

If the determination in operation 310 determines to activate the additional indicator again, then the method can return to operation 306 which again activates the additional indicator. Note that the positions of the main reels would typically remain the same. Thus, if a selected award on the additional indicator is a multiplier of a win on the main reels (game), then whatever win the player earned on the previous main game would be used for additional activations of the additional indicator. Thus, if the player won a large award on the main game, then additional activations of the additional indicator (if a multiplier was a potential award on the additional indicator) would have a greater value (than if the player won a smaller or no award on the main game) because each activation of the additional indicator could potentially multiply a win earned on the main reels (game).

In FIG. 3, the main reels remain frozen while the additional indicator (also known as additional award indicator) can be successively activated. Thus, a multiplier on successive activations of the additional indicator in the example in FIG. 3 multiplies a same award which is based on the current main reel combinations being displayed. In a further embodiment, the main reels can spin again while (or before or after) the additional indicator is activated (and/or successively activated). Thus, a multiplier on successive activations of the additional indicator can multiply a different award since the main reels can spin for each activation of the additional indicator.

Figure 4:
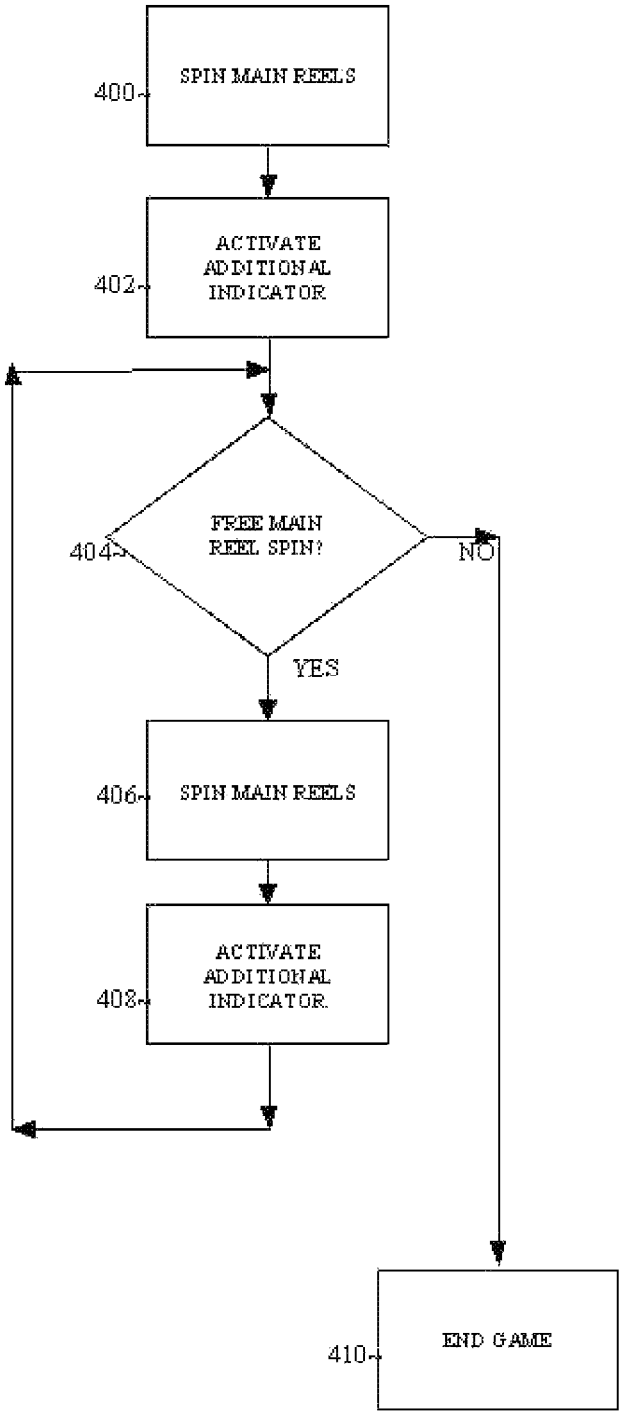
FIG. 4 is a flowchart illustrating an exemplary method of implementing an additional award indicator with multiple activations of both the additional award indicator and the main reels, according to an embodiment.

FIG. 4 is a flowchart illustrating an exemplary method of implementing an additional award indicator with multiple activations of both the additional award indicator and the main reels, according to an embodiment.

The method can begin with operation 400, wherein the player would make an initial (or main) wager and then press a button to spin the main reels. An award based on the resultant combination can be awarded now (or at a later time).

From operation 400, the method can proceed to operation 402, which activates an additional award indicator. This operation (activating the additional award indicator) can be optional. The additional award indicator can be activated (either without an additional indicator wager by the player in addition to the initial wager) only if the player makes an extra wager (an additional indicator wager). Alternatively, the additional award indicator can be activated for free (e.g., without the player placing the additional indicator wager, although the player still needs to make the initial wager).

In an embodiment, operation 402 does not occur and the additional award indicator does not get activated at this point in time.

From operation 402 (or operation 400 if operation 402 is not implemented), the method can proceed to operation 404, which determines whether the player is entitled to a free spin of the main reels (e.g., a free game). A free spin (or more than one free spin) can be earned in a number of ways. For example, a purely random determination can determine whether the player gets one or more free spins (e.g., the player can receive from 0-5 free spins randomly with each new game). Alternatively, the symbols on the main reels can form a predetermined combination which awards one or more free spin(s). If the player has not earned a free spin (or any more free spins), then the method can proceed to operation 410, which ends the game.

If the player has an additional free spin coming, then the method can proceed to operation 406, which spins the main reels. Another award can also be awarded to the player based on a resulting combination of the reels after this spin.

From operation 406, the method can proceed to operation 408, wherein additional award indicator can be activated. The award selected on the additional award indicator may depend on the currently displayed reel combination (e.g., the last award awarded or computed in operation 406 based on the main reels), for example if the selected award is a multiplier (e.g., the last award earned on the main reels is multiplied by 2 {or any other number}).

If the player is required to pay for each additional activation of the additional award indicator, then the wager amount for each new activation of the additional award indicator remains the same as the additional indicator wager the player made in operation 402. If the player did not make an additional indicator wager in operation 402, and the player is required to pay for each additional activation of the additional award indicator, then the wager amount for each new activation of the additional award indicator can be fixed at a predetermined amount (e.g., $1) or it can be a variable amount.

If the player is not required to pay for additional activation (s) of the additional award indicator (e.g., the player has won free activations), then the prize(s) awarded can be determined based on a constant additional award wager (such as the amount that the player made in operation 402) or alternatively such a constructive wager amount may not be necessary and prizes can be awarded without basing them on a wager. If the player did not have to make an additional award wager in operation 402 and earned free additional activations, and the player is not required to pay for the additional activations of the additional award indicator, then the prize(s) awarded can still be determined based on a constant additional award wager (e.g., $1) or alternatively such a constructive wager amount may not be necessary and prizes can be awarded without basing them on a wager.

It is noted that the wager amount during operation 406 does not change from the wager amount in operation 400. If the spins in operation 406 are free, there is technically no "wager amount" even though an award is awarded based on the resultant combination because this is a free spin. Nevertheless, the payouts for the award is determined based on the prior wager amount from operation 200, e.g., the active lines and bet per line remain the same. Thus, for example, if the same combination appeared in operation 406 as appeared in operation 400, then the award would be the same (although in an alternative embodiment the payouts would not be the same as different wager amount(s) and/or payline(s) and/or pay-table(s) can be used).

From operation 408, the method can return to operation 404 which determines whether there are any additional free spins to award the player. For example, after operation 400 or operation 402, the player may have earned five free spins. Thus, operations 404-408 will repeat five times so that the player would have received his or her five free spins.

An example of the embodiment illustrated in FIG. 4 will now be presented. The player places a $2 initial wager and spins the reels. The additional award indicator is not activated at this time (operation 302 is not performed). The resulting combination on the reels awards the player an award of $5 and also two free spins with activations of the additional award indicator. The main reels spin again and the additional award indicator is activated. A resultant award from combinations on the main reels awards the player $1, and the award selected on the additional award indicator is a 3 times multiplier. Thus, the player has won $3 on the first free spin. The main reels spin again and the additional ward indicator is activated again. A resultant award from combinations on the main reels awards the player $7 and the awarded selected on the additional award indicator is a 5 times multiplier. Thus, the player has won $35 on the second free spin. The game now ends and the player has won a total of $43 from the player's total wager of $2.

In the above example, each activation of the additional award indicator was free, but in a further embodiment, the player would be required to pay extra for each activation. The extra money could automatically come out of the player's credit meter (or award earned from main game, e.g., operation 300). The player can be prompted as to whether the player wishes to pay for the activation of the additional award indicator or the player can pay automatically. If each activation of the additional award indicator cost $2, then the player would have paid $2 (2 times $1) in the above example for the two activations of the additional award indicator. If the player is to pay money (an additional wager) to activate (and receive potential awards from) the additional award indicator (e.g., perimeter prize wheel or other indicator), then the additional wager can be collected when the initial wager is collected from the player (to play the main game). The initial wager and the additional wager can come in discrete units (e.g., $1 for the initial wager to play the main game and $0.50 for the additional wager to activate (and collect potential awards from) the additional award indicator. Of course if the player chooses not to pay to activate the additional award indicator, then the player cannot earn a prize from the additional award indicator (although the additional award indicator may still activate even if the player hasn't paid just to show the player what the player would have won if the player had paid to activate the additional award indicator). Alternatively, the additional award indicator would not activate if the player did not pay to indicate the additional award indicator. Alternatively, if the player is to pay to activate the additional award indicator (and collect potential awards obtained/selected/received on the additional award indicator) then both wagers can be combined together (e.g., $1.00 to play the main game and activate the additional award indicator). In this latter embodiment, the player may or may not have a choice of whether to pay for and activate the additional award indicator.

Thus, compare the method illustrated in FIG. 4 with the method illustrated in FIG. 3. In FIG. 3, whenever the additional award indicator is activated, the main reels remain frozen, while in FIG. 4, the main reels spin again each time the additional award indicator is activated. This can affect the prize awarded because some prizes/awards on the additional award indicator can be a function of the prize awarded/displayed for the main reels.

In yet a further embodiment, additional activations of the additional award indicator can be free, but the player would have to pay for additional spin(s) of the main reels. Thus, in FIG. 4, instead of awarding free spin(s), the game can award free activation(s) of the additional award indicator while the player would be required to pay for additional spins of the main reels which would be associated with the free activation (s) of the additional award indicator.

In yet another embodiment, both additional activation(s) of the additional award indicator can be free and corresponding free spin(s) are awarded as well. Thus, the player can earn, for example, two free spins each with an activation of the additional award indicator, without having to pay anything additional.

In a further embodiment, if a condition on the player's bet meets a predetermined criteria (or criterion), then the player can receive a free activation of the additional award indicator. For example, if the player (for example in operation 300) plays max bet (or max lines, or bets greater than a predetermined amount, etc.) then the additional award indicator can automatically activate. This can serve as an incentive for the player to bet a particular amount (e.g., max bet or max lines) since the player will then receive a free activation of the additional award indicator.

As described herein, in an embodiment the player must pay for an initial activation of the additional award indicator (e.g., in operation 302). In one embodiment, the player can bet as much as the player wishes and can always place the additional indicator wager in order to activate the additional award indicator (e.g., the player can bet $5 on the main game and the $1 additional award wager). In a further optional variation of this embodiment, the player can only pay for activation of the additional award indicator if the player's bet on the main will satisfy an initial condition. For example, the player can be required to bet max lines (or max bet) before the player is then allowed to purchase (e.g., make the additional indicator wager). For example, max bet (the maximum the player is allowed to bet) of a slot game can be $10, and an activation of the additional award indicator can cost $1. Thus, the player would pay $11 to play max bet and activate the additional award indicator. In this embodiment, the player would not be allowed to make the $1 additional indicator wager until the player's original bet satisfies a condition (e.g., is greater than (or greater than or equal to) a predetermined wager amount). Thus, the only way the player can activate the additional award indicator is to play max bet and to make (pay) the additional indicator wager. The player may still be allowed to play max bet and choose not to make the additional indicator wager (but then of course the additional award indicator would not be activated).

Thus, in an embodiment, the player may be required to fulfill a betting condition before being allowed to make a bet which activates the additional award indicator (the additional indicator wager). The condition can be any of the following: player wagers max lines (the most lines available or at least a minimum number of lines) on the main game; player wagers max bet (the largest bet possible); player wagers a minimum of $x (where x can be any dollar amount); a combination of a minimum number of lines with a minimum amount bet on each of those lines; or any other condition on the player's initial (or other) wager. For example, if the requirement is the player bets a minimum of 20 lines, then the player must play 20 lines (or more) in order to be able to purchase an activation of the additional award indicator.

The amount bet on the additional indicator (the additional indicator wager) can be predetermined (e.g., must be a particular amount such as $1), or can be variable based on the player's choice. For example, the player can bet $1 or $2 on the additional indicator wager, the latter typically doubling (or approximately doubling) the expected value of any award (s) from the activation(s) of the additional indicator wager.

In any of the embodiments described herein, the additional award indicator can be activated simultaneously as the main reels are spinning. Thus, the additional award indicator can spin (or whatever other action the particular additional award indicator may display) while the main reels are spinning. They can both stop spinning at the same time, or they can both stop spinning at different times. In a further embodiment, the additional award indicator can activate after the main reels have stopped spinning.

Figure 5A:
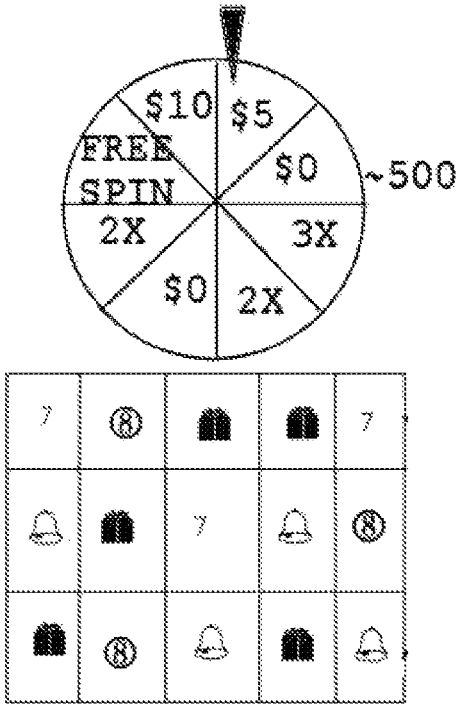
FIG. 5A is an example of using a wheel as an additional award indicator, according to an embodiment.

FIG. 5A is an example of using a wheel as an additional award indicator, according to an embodiment. The wheel 500 can appear alongside the main reels (as illustrated) or alternatively can be displayed in place of the main reels when the wheel is being spun.

Figure 5B:
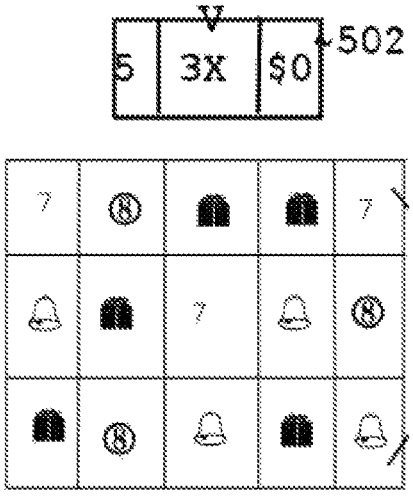
FIG. 5B is an example of using an additional reel as an additional award indicator, according to an embodiment.

FIG. 5B is an example of using an additional reel as an additional award indicator, according to an embodiment. In this example the reel 502 is a horizontal reel, although a vertical reel can be used as well.

Figure 6:
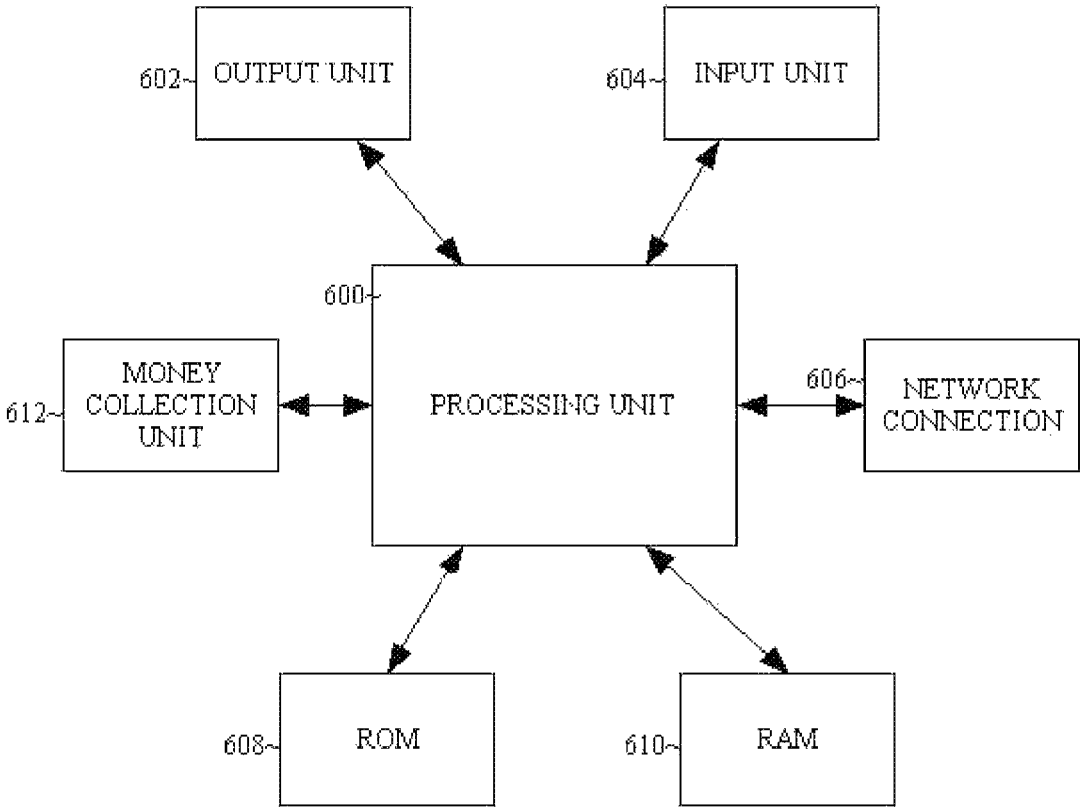
FIG. 6 is a block diagram of one example of hardware that can be used to implement the method, according to an embodiment.

FIG. 6 is a block diagram of one example of hardware that can be used to implement the method, according to an embodiment.

A processing unit 600 (which can comprise a microprocessor and related components) can be connected to an output unit 602 (e.g., LCD or touch screen, etc.), an input unit 604 (e.g. a touch screen, keyboard, buttons, etc.), a network connection 606 (e.g. connection to a casino server or the Internet or other communication network), a ROM 608, a RAM 610, and any other hardware known in the art needed to implemented a digital version of the game (not pictured). The game can also be served to a remote client playing at an online casino over a computer communications network (such as the internet). A money collection unit 612 can be used to receive cash (or other payment from such as electronic payment) and credit the payment to the machine so that the player can play with the money deposited.

All of the embodiments described herein can also be applied to a physical slot machine with physical reels that does not use an electronic (video) display to display the game.

Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The descriptions provided herein also include any hardware and/or software known in the art and needed to implement the operations described herein. All components illustrated herein may also optionally communicate with any other illustrated or described component.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method comprising:

receiving a wager for a turn of a game to be played using a slot machine;

spinning, using the slot machine, a set of reels;

stopping the set of reels at a first reel combination;

awarding a first prize based on the first reel combination and the wager;

prior to activating an additional award indicator at the slot machine a first time during the turn of the game, determining, by processing unit, a number of times to activate the additional award indicator prior to ending the turn of the game, wherein the additional award indicator is configured to indicate at least one of a plurality of awards;

activating, during the turn of the game, the additional award indicator the first time of the determined number of times so as to animate the additional award indicator until the additional award indicator stops and displays a first award selected from the plurality of awards, and then awarding a second prize determined using (i) the first prize based on the first reel combination and the wager, and (ii) the first award displayed by the additional award indicator in response to activating the additional award indicator the first time;

after activating the additional award indicator the first time during the turn of the game, activating, during the turn of the game, the additional award indicator a second time of the determined number of times so as to animate the additional award indicator a second time during the turn of the game until the additional award indicator stops and displays a second award selected from the plurality of awards, and then awarding a third prize determined using (i) the same first prize used to determine the second prize, and (ii) the second award displayed by the additional award indicator in response to activating the additional award indicator the second time; and ending the turn of the game after the additional award indicator is activated the number of times during the turn of the game.

2. The method of claim 1, wherein activating the additional award indicator the number of times further includes determining whether to activate the additional award indicator the first time, and wherein determining whether to activate the additional award indicator the first time is based on a random determination.

3. The method of claim 1, wherein determining the number of times to activate the additional award indicator prior to ending the turn of the game occurs after stopping the set of reels at the first reel combination, and wherein determining the number of times to activate the additional award indicator prior to ending the turn of the game is based on the first reel combination.

4. The method of claim 1, wherein activating the additional award indicator the number of times further includes determining whether to activate the additional award indicator the first time, and wherein determining whether to activate the additional award indicator the first time is based on a number of previous spins of the set of reels of the slot machine.

5. The method of claim 1, wherein determining the number of times to activate the additional award indicator prior to ending the turn of the game is based on the wager.

6. The method of claim 1, wherein the number of times to activate the additional award indicator is based on the first reel combination.

7. The method of claim 1, wherein the number of times to activate the additional award indicator is based on a number of previous spins of the set of reels of the slot machine.

8. The method of claim 1, wherein the number of times to activate the additional award indicator is based on an additional wager associated with the additional award indicator.

9. The method of claim 1, further comprising:

freezing the set of reels at the first reel combination while the additional award indicator is activated.

10. The method of claim 1, wherein the plurality of awards includes at least one of (i) a zero multiplier award, (ii) a non-zero multiplier award, (iii) a free spin award, (iv) a fixed dollar amount award, and (v) a bonus round entry.

11. The method of claim 1, wherein the additional award indicator is one of (i) a perimeter prize wheel, (ii) an additional reel associated with the set of reels, (iii) a separate reel, or (iv) a separate window configured to display a determined award.

12. The method of claim 1, wherein at least one of the second prize and the third prize is zero.

13. An article of manufacture including tangible non-transitory computer readable media with instructions encoded therein, the instructions comprising:

instructions for receiving a wager for a turn of a game to be played using a slot machine having a set of reels:

instructions for spinning the set of reels;

instructions for stopping the set of reels at a first reel combination;

instructions for awarding a first prize based on the first reel combination and the wager;

instructions for determining, prior to activating an additional award indicator at the slot machine a first time during the turn of the game, a number of times to activate the additional award indicator prior to ending the turn of the game, wherein the additional award indicator is configured to indicate at least one of a plurality of awards;

instructions for activating, during the turn of the game, the additional award indicator the first time of the determined number of times so as to animate the additional award indicator until the additional award indicator stops and displays a first award selected from the plurality of awards, and then awarding a second prize determined using (i) the first prize based on the first reel combination and the wager, and (ii) the first award displayed by the additional award indicator in response to activating the additional award indicator the first time;

instructions for activating during the turn of the game, after activating the additional award indicator the first time during the turn of the game, the additional award indicator a second time of the determined number of times so as to animate the additional award indicator a second time during the turn of the game until the additional award indicator stops and displays a second award selected from the plurality of awards, and then awarding a third prize determined using (i) the same first prize used to determine the second prize, and (ii) the second award displayed by the additional award indicator in response to activating the additional award indicator the second time; and ending the turn of the game after the additional award indicator is activated the number of times during the turn of the game.

14. The article of manufacture of claim 13, wherein the number of times to activate the additional award indicator is based on at least one of (i) a random number determination, (ii) the first reel combination, (iii) a number of previous spins of the set of reels of the slot machine, and (iv) the wager.

15. The article of manufacture of claim 13, further comprising:

instructions for freezing the set of reels at the first reel combination while the additional award indicator is activated.

16. The article of manufacture of claim 13, wherein the plurality of awards includes at least one of (i) a zero multiplier award, (ii) a non-zero multiplier award, (iii) a free spin award, (iv) a fixed dollar amount award, and (v) a bonus round entry.

17. The article of manufacture of claim 13, wherein the additional award indicator is one of (i) a perimeter prize wheel, (ii) an additional reel associated with the set of reels, (iii) a separate reel, or (iv) a separate window configured to display a determined award.

18. A slot machine system comprising:

a money collection unit configured to receive a wager for a turn of a game to be played using a slot machine;

an input unit configured to accept commands from a player of the slot machine;

a processing unit configured to (i) spin a set of reels at the slot machine, (ii) stop the set of reels at a first reel combination, (iii) award a first prize based on the first reel combination and the wager, (iv) determine, prior to activating an additional award indicator at the slot machine a first time during the turn of the game, a number of times to activate the additional award indicator prior to ending the turn of the game, wherein the additional award indicator is configured to indicate at least one of a plurality of awards, (v) activate, during the turn of the game, the additional award indicator the first time of the determined number of times so as to animate the additional award indicator until the additional award indicator stops and displays a first award selected from the plurality of awards and then awarding a second prize determined using the first prize based on the first reel combination and the wager and the first award displayed by the additional award indicator in response to activating the additional award indicator the first time, (vi) activate, during the turn of the game after activating the additional award indicator the first time during the turn of the game, the additional award indicator a second time of the determined number of times so as to animate the additional award indicator a second time during the turn of the game until the additional award indicator stops and displays a second award selected from the plurality of awards, and then awarding a third prize determined using the same first prize used to determine the second prize and the second award displayed by the additional award indicator in response to activating the additional award indicator the second time; and one or more output devices configured to display the set of reels, the additional award indicator, awards, and prizes.

19. The slot machine system of claim 18, wherein the processing unit is configured to determine whether to activate the additional award indicator the first time based on at least one of (i) a random number determination, (ii) the first reel combination, (iii) a number of previous spins of the set of reels of the slot machine, and (iv) the wager; and wherein the processing unit is further configured to determine whether to activate the additional award indicator the second time based on at least one of (i) a random number determination, (ii) the first reel combination, (iii) a number of previous spins of the set of reels of the slot machine, (iv) the wager, and (v) an additional wager associated with the additional award indicator.

20. The slot machine system of claim 18, wherein the plurality of awards includes at least one of (i) a zero multiplier award, (ii) a non-zero multiplier award, (iii) a free spin award, (iv) a fixed dollar amount award, and (v) a bonus round entry.

21. The slot machine system of claim 18, wherein the additional award indicator is one of (i) a perimeter prize wheel, (ii) an additional reel associated with the set of reels, (iii) a separate reel, or (iv) a separate window configured to display a determined award.

* * * * *